US005836465A

United States Patent [19]

King

[11] Patent Number: 5,836,465

[45] Date of Patent: *Nov. 17, 1998

[54] CHILD-RESISTANT CLOSURE ASSEMBLIES

[75] Inventor: Roger M. King, Latimer, United Kingdom

[73] Assignee: Beeson and Sons Limited, Rickmansworth, United Kingdom

[ * ] Notice: The portion of the term of this patent subsequent to Jun. 5, 2015, has been disclaimed.

[21] Appl. No.: 743,519

[22] Filed: Nov. 4, 1996

Related U.S. Application Data

[63] Continuation of Ser. No. 463,216, Jun. 5, 1995, Pat. No. 5,638,969.

[30] Foreign Application Priority Data

Apr. 18, 1996 [GB] United Kingdom ..... 9507892

[51] Int. Cl.[6] ..... B65D 55/02

[52] U.S. Cl. ..... 215/216; 215/44; 215/222; 215/252; 215/344; 215/352; 215/354

[58] Field of Search ..... 215/206, 213, 215/214, 216, 217, 219, 221, 222, 252, 334, 341, 344, 352, 354, 44

[56] References Cited

U.S. PATENT DOCUMENTS

| | | | |
|---|---|---|---|
| D. 207,887 | 6/1967 | Parsisson . | |
| D. 327,644 | 7/1992 | Offley et al. . | |
| D. 329,980 | 10/1992 | Powell et al. . | |
| D. 364,808 | 12/1995 | King . | |
| 3,770,153 | 11/1973 | Gach et al. . | |
| 3,917,097 | 11/1975 | Uhlig . | |
| 3,941,268 | 3/1976 | Owens et al. . | |
| 3,944,102 | 3/1976 | Grau . | |
| 3,984,021 | 10/1976 | Uhlig | 215/216 |
| 3,993,209 | 11/1976 | Julian . | |
| 4,093,096 | 6/1978 | Augros . | |
| 4,098,419 | 7/1978 | Virog, Jr. et al. | 215/252 |

(List continued on next page.)

FOREIGN PATENT DOCUMENTS

| | | | |
|---|---|---|---|
| 0 110 709 | 6/1984 | European Pat. Off. . | |
| 0 182 519 | 5/1986 | European Pat. Off. . | |
| 0 257 481 | 3/1988 | European Pat. Off. . | |
| 0 443 868 | 8/1991 | European Pat. Off. . | |
| 724431 | 4/1932 | France . | |
| 704508 | 4/1966 | Italy . | |
| 1 387 572 | 3/1975 | United Kingdom . | |
| 1387572 | 3/1975 | United Kingdom | 215/216 |
| 1434546 | 5/1976 | United Kingdom | 215/221 |

(List continued on next page.)

OTHER PUBLICATIONS

U.S. Serial No. 08/193,610, filed on Feb. 8, 1994 by King.

U.S. Serial No. 08/317,999, filed on Oct. 4, 1994 by King et al.

U.S. Serial No. 08/486,041, filed on Jun. 7, 1995 by King et al.

(List continued on next page.)

*Primary Examiner*—Stephen K. Cronin

*Attorney, Agent, or Firm*—Brinks Hofer Gilson & Lione

[57] ABSTRACT

A child-resistant container and closure assembly having a container neck with a first screw thread and two first locking elements located below the first screw thread on opposite sides of the container neck. A closure for the container neck has a second screw thread complementary to the first screw thread, a resiliently deformable skirt, and two second locking elements on opposite sides of the resiliently deformable skirt. The first and second locking elements mutually engage in ratchet fashion when the closure is screwed onto a fully engaged position on the container neck and subsequently block unscrewing of the closure unless a radial pressure is applied to the skirt at positions spaced from the locking elements to deform the skirt to release the locking elements. The first and second threads are two-start, fast-turn threads so that the closure can be moved from a substantially fully disengaged position to a substantially fully engaged position on the neck by rotation through about 180° or less.

16 Claims, 4 Drawing Sheets

U.S. PATENT DOCUMENTS

| | | | |
|---|---|---|---|
| 4,106,654 | 8/1978 | Jones | 215/329 |
| 4,117,945 | 10/1978 | Mumford | 215/216 |
| 4,134,513 | 1/1979 | Mumford | 215/216 |
| 4,213,534 | 7/1980 | Montgomery . | |
| 4,280,631 | 7/1981 | Lohrman | 215/204 |
| 4,351,443 | 9/1982 | Uhlig | 215/216 |
| 4,383,620 | 5/1983 | Mumford . | |
| 4,413,743 | 11/1983 | Summers . | |
| 4,436,211 | 3/1984 | Gach . | |
| 4,452,363 | 6/1984 | Davis | 215/216 |
| 4,471,878 | 9/1984 | Davis et al. . | |
| 4,480,760 | 11/1984 | Schonberger . | |
| 4,527,701 | 7/1985 | Schaubeck . | |
| 4,605,135 | 8/1986 | Ryder . | |
| 4,754,892 | 7/1988 | Retief . | |
| 4,756,435 | 7/1988 | Schick et al. . | |
| 4,782,965 | 11/1988 | Wassilieff . | |
| 4,957,210 | 9/1990 | Kusz . | |
| 5,020,681 | 6/1991 | Kusz . | |
| 5,103,991 | 4/1992 | Collins . | |
| 5,213,225 | 5/1993 | King et al. . | |
| 5,219,084 | 6/1993 | King . | |
| 5,307,945 | 5/1994 | Hidding et al. | 215/329 |
| 5,411,157 | 5/1995 | King et al. . | |
| 5,454,476 | 10/1995 | King et al. . | |
| 5,533,633 | 7/1996 | King . | |
| 5,588,545 | 12/1996 | King . | |
| 5,590,799 | 1/1997 | King . | |
| 5,611,443 | 3/1997 | King | |

FOREIGN PATENT DOCUMENTS

| | | |
|---|---|---|
| 1 438 885 | 6/1976 | United Kingdom . |
| 2 011 869 | 7/1979 | United Kingdom . |
| 2 031 856 | 4/1980 | United Kingdom . |
| 1 603 667 | 11/1981 | United Kingdom . |
| 2 114 552 | 8/1983 | United Kingdom . |
| 2 155 447 | 9/1985 | United Kingdom . |
| 2 203 729 | 10/1988 | United Kingdom . |
| 2 257 693 | 1/1993 | United Kingdom . |
| 2 260 534 | 4/1993 | United Kingdom . |
| 2 261 656 | 5/1993 | United Kingdom . |
| 2 262 280 | 6/1993 | United Kingdom . |
| 2 264 108 | 8/1993 | United Kingdom . |
| 2 267 076 | 11/1993 | United Kingdom . |
| 2 267 082 | 11/1993 | United Kingdom . |
| 2 267 484 | 12/1993 | United Kingdom . |
| WO 93/01098 | 1/1993 | WIPO . |
| WO 94/11267 | 5/1994 | WIPO . . |

OTHER PUBLICATIONS

U.S. Serial No. 08/436,338, filed on May 12, 1995 by King et al.
U.S. Serial No. 08/463,216, filed on Jun. 5, 1995 by King.
U.S. Serial No. 08/477,903, filed on Jun. 7, 1995 by King.
U.S. Serial No. 08/470,351, filed on Jun. 6, 1995 by King.
U.S. Serial No. 29/044,138, filed on Sep. 18, 1995 by King.
U.S. Serial No. 29/046,524, filed on Nov. 17, 1995 by King.
U.S. Serial No. 29/060,164, filed on Sep. 24, 1996 by King et al.

CHILD-RESISTANT CLOSURE ASSEMBLIES

This application is a continuation of application Ser. No. 08/463,216, filed Jun. 5, 1995 now U.S. Pat. No. 5,638,969.

This invention relates to improvements in child-resistant container and closure assemblies. In particular, it relates to screw-threaded closure assemblies of the type wherein, in order to unscrew the closure from the fully engaged position on the neck, it is necessary to apply a radial pressure to a skirt portion of the closure to deform the skirt portion in order to overcome the child-resistant feature.

Child-resistant closure assemblies of the above type are described, for example, in GB-A-2011869, GB-A-2114552 and EP-A-0443868. Such assemblies comprise: a container neck having a first, external screw thread and two first locking elements located below the first screw thread on opposite sides of the neck, and a closure for the neck comprising a second, internal screw thread complementary to the first screw thread, a resiliently deformable skirt, and two second locking elements on opposite sides of the resiliently deformable skirt, wherein the first and second locking elements mutually engage in ratchet fashion when the closure is screwed onto a fully engaged position on the closure neck. The first and second locking elements subsequently block unscrewing of the closure unless a radial pressure is applied to the resiliently deformable skirt at positions spaced from the locking elements to deform the skirt and thereby release the locking elements.

Container and closure assemblies of the above type suffer from certain drawbacks. First, it has proved difficult in practice to provide such container and closure assemblies with effective sealing means to prevent leakage of fluid content from inside the container when the closure is fully engaged on the container neck. This is because the resiliency of the closure skirt allows rocking of the closure on the container neck, and this rocking can sometimes allow fluids to escape from inside the container. A second drawback of container and closure assemblies as described above is that it is has not hitherto been possible to make such assemblies elderly-friendly by the provision of multi-start, fast-pitched threads on the container and closure. This is because engagement of the locking elements requires that the closure must be fully engaged on the container neck at a predetermined angular position. If multi-start threads are present, then there is the possibility that, for at least some thread start positions, the fully engaged position of the closure on the neck will not be consistent with engagement of the locking elements on the closure and the neck. Furthermore, the provision of steeply pitched threads exacerbates the problem of rocking of the closure on the neck. A third drawback of the existing child-resistant closure assemblies of this type is that it is difficult to provide a satisfactory tamper-evident ring on the closure. This is because of the conflicting requirements of substantial clearance between the deformable skirt of the closure (necessary to allow deformation of the skirt to release the locking elements) and the necessity for the tamper-evident ring to be retained on the neck when the closure is removed from the container neck for the first time.

U.S. Pat. No. 3,770,153 describes a child-resistant container and closure assembly of the above general type. In one embodiment, the threads on the container and closure are broken threads having a low pitch angle, whereby the closure is fully engaged on the container neck by thrusting the closure onto the neck, followed by rotating the closure through about 90° to engage the threads and the locking elements. The closure is disengaged from the container neck by squeezing the closure skirt at right angles to the positions of the locking elements to deform the closure skirt and thereby release the locking elements, followed by unscrewing the closure through approximately 90° and then lifting the closure vertically off the neck. This arrangement is somewhat more elderly-friendly than conventional container and closure assemblies of this type. However, it still requires three mechanical operations (squeezing, turning and then lifting) to disengage the closure from the neck. Moreover, the problems of providing an effective seal between the container neck and closure and the problem of providing an effective tamper-evident ring on the closure are not solved by the assembly of U.S. Pat. No. 3,770,153.

Accordingly, it is an object of the present invention to provide a child-resistant container and closure assembly wherein the closure can be moved from a fully disengaged position to a fully engaged position on the container neck by rotation through about 90° or less.

It is a further object of the present invention to provide a child-resistant container and closure assembly as above having improved sealing means between the container and closure when the closure is fully engaged on the container neck.

It is a further object of the present invention to provide a container and closure assembly as above having a reliable tamper-evident ring.

Accordingly, the present invention provides a child-resistant container and closure assembly comprising: a container neck having a first screw thread and two first locking elements located below the first screw thread on opposite sides of the neck; and a closure for the neck having a second screw thread complementary to the first screw thread, a resiliently deformable skirt, and two second locking elements on opposite sides of the resiliently deformable skirt, wherein the first and second locking elements are adapted to mutually engage in ratchet fashion when the closure is screwed onto a fully engaged position on the container neck and subsequently to block unscrewing of the closure unless a radial pressure is applied to the skirt at positions spaced from the locking element to deform the skirt to release the locking elements, characterised in that the first and second threads are two-start, fast-turn threads, whereby the closure can be moved from a substantially fully disengaged position to a substantially fully engaged position on the neck by rotation through about 180° or less. Preferably, the closure is moved from a substantially fully disengaged position to a substantially fully engaged position on the neck by rotation through about 90° or less.

Broadly, the preferred thread configuration on the container neck and closure are steeply pitched, fast-turn threads having two-fold rotational symmetry about the longitudinal axis of the assembly. In contrast, prior art closure assemblies of this type generally comprise single-start threads, resulting in unacceptable rocking of the closure on the container neck as the closure is screwed down. Moreover, such single-start threads are less elderly-friendly and require more rotation to engage the closure on the neck. Preferably, the first and second threads comprise two substantially continuous upstanding thread portions on the container neck and two substantially continuous upstanding thread portions on the closure. More preferably, the two upstanding thread portions on the container neck have substantially identical shapes and the two upstanding thread portions on the closure have substantially identical shapes. In other preferred embodiments, there are four upstanding one-quarter turn thread portions on each of the container neck and the closure, said four thread portions comprising blocking means whereby the closure can only be screwed onto the container neck from two, diametrically opposed orientations of the closure on the neck. Preferably, the blocking means are provided by providing the four thread portions with alternately relatively thick and thin transverse cross-sections.

Preferably, the average pitch of the first and second threads is from 5° to 30°. More preferably, the average pitch of the first and second threads is in the range of from 8° to 20°. Most preferably, the average pitch of the first and second threads is about 12°. The two-start, fast-turn threads are a novel and advantageous feature of the present invention. Conventional elderly-friendly closures are known which have four-start, one quarter-turn closure threads. These threads comprise four identical, radially equidistant one quarter-turn thread portions spaced around the container and closure. As a result, these threads allow the closure to be fully engaged on the container neck by rotation through about 90° from four rotationally equidistant starting orientations. However, such thread arrangements are not suitable for child-resistant container and closure assemblies of the present type. This is because, with diametrically opposed locking elements on the container and closure, there are only two rotational start position of the closure on the neck that will ensure that the respective locking elements on the cap and the neck engage when the closure is fully screwed down. It follows that a two-start or one-start thread is necessary in order to ensure engagement of the locking elements. However, in the course of extensive testing, it has been found that one-start steeply pitched threads give rise to unacceptable rocking of the closure on the container neck and can be difficult to engage. Hence, it has been found that the balanced, two-start threads of the present invention is the optimum configuration. The use of a steeply pitched one quarter-turn thread means that the closure can be fully disengaged from the container neck merely by rotation through about 180° or less, and without the additional lifting operation required for the assembly of U.S. Pat. No. 3,770,153. This also makes the assembly according to the present invention more elderly-friendly without compromising child-resistance.

The threads on the closure assemblies according to the present invention are fast-turn threads. That is to say, the closure is moved from a fully disengaged position on the container neck to a fully engaged position on the container neck by rotation through about 180° or less, preferably about 90° or less.

The container and closure assembly according to the present invention preferably further comprises a first circumferential sealing surface on the container neck and a second circumferential sealing surface on the closure, whereby the first and second sealing surfaces abut to form a seal when the closure is fully engaged on the container neck. Preferably, one or both circumferential sealing surfaces is provided with a circumferential sealing rib, for example a rib of substantially triangular cross-section, to improve the seal between the circumferential sealing surfaces. Preferably, the first sealing surface is a frustoconical surface on the outside of the container neck and the second sealing surface is a complementary frustoconical sealing surface on the inside of a skirt portion (which may or may not be the resilient skirt) of the closure. Preferably, the frustoconical surfaces are inclined at an angle of from 2° to 10°, more preferably about 5°, to the longitudinal axis of the assembly. In other preferred embodiments, the first sealing surface is an interior surface of the neck of the container and the second sealing surface is an external surface of a cylindrical plug projecting from the inner surface of a crown portion of the closure. In other words, in these embodiments the closure is provided with a plug seal extending from its base that fits snugly into the top of the container neck to form a seal. In still other preferred embodiments, the closure is alternatively or additionally provided with a compressible sealing disc inside its base for sealing against the lip of the container neck.

The advantage of the use of such sealing means in conjunction with the steeply pitched one quarter-turn threads of the assembly of the present invention include the following. First, the two-start threads on the container and closure are rotationally symmetrical and thereby reduce rocking of the closure on the container that could bring the sealing surfaces out of sealing engagement in the fully closed position. Second, the steep pitch of one quarter-turn threads allows the sealing surfaces to be brought into tight sealing engagement when the closure is fully engaged on the container neck without unacceptable friction between the sealing surfaces when screwing or unscrewing the closure from its fully engaged position.

A secure sealing engagement between the sealing surfaces can be further ensured by the following means. Preferably, the first and second locking elements are configured such that the abutment between the first and second locking elements applies a positive closure torque to the closure when the closure is fully engaged on the container neck. More preferably, when the closure is fully engaged on the container neck, the first or second locking element abuts a ramp portion on the second or first locking element and the resilient skirt is resiliently deformed, whereby the resilient skirt exerts a radial pressure on the first locking element, and the abutment between the first locking element and the second locking element at the ramp portion converts part of said radial pressure into a positive closure torque. Still more preferably, a ramp portion on the first locking element abuts a complementary ramp portion on the second locking element. The term "ramp portion" refers to a radial side of the locking element that is inclined at an angle to a diameter of the neck or the closure such that radial pressure applied to the ramp portion is converted into a closure torque that urges the container neck and the closure towards the closed position of the closure on the neck. Urging means of this type are described in more detail in our copending application GB-A 2267484, the entire disclosure of which is incorporated herein by reference The above arrangements help to ensure a positive sealing force between the sealing surfaces on the closure and the neck. Moreover, this arrangement helps to reduce accidental backing-off of the closure from the container neck during ordinary handling of the assembly. This arrangement reduces the risk of under-tightening of the closure on the container neck, since provided that the ramp surfaces of the locking elements are brought into abutment, the resulting positive closure torque will automatically complete tightening of the closure on the container neck. Finally, this arrangement allows less precise manufacturing tolerances to be used in the manufacture of the container neck and closure, since it is no longer essential for the locking elements to be very precisely positioned relative to the sealing surfaces in order to ensure that the sealing surfaces are precisely in abutment when the locking elements engage. This is because the ramped locking elements allow the closure to be secured on the container neck over a small range of angular positions, instead of at one exact angular position. This is particularly important in the case of two-start, one quarter-turn steeply pitched threads, where very small differences in angular position can give rise to significant vertical misalignment of the sealing surfaces owing to the steep pitch of the threads. Therefore, the combination of the ramped locking elements with the closure threads of the present invention is particularly advantageous.

Preferably, the container and closure assembly according to the present invention further comprises: a circumferential retaining lip on the container neck below the first thread; and a tamper-evident ring attached to the resilient skirt by frangible bridges and provided with an abutment surface that locates under the retaining lip when the closure is fully engaged on the container neck, whereby abutment between the abutment surface and the retaining lip causes the tamper-evident ring to separate from the closure when the closure is disengaged from the container neck for the first time.

Preferably, the tamper-evident ring comprises an annular portion attached to the resilient skirt by the frangible bridges, and one or more upwardly and inwardly inclined flexible fins attach to the annular portion, each fin having a leading edge that locates under the retaining lip to provide said abutment surface, said annular portion having a greater internal diameter than the maximum diameter of the retaining lip. This arrangement allows the tamper-evident ring to snap-fit over the retaining lip when the closure is fitted onto the container neck for the first time. This snap-fitting takes place without undue strain the frangible bridges, since it is not necessary to deform the annular portion in order to fit it over the retaining lip. Instead, the flexible fins bend back to pass over the circumferential retaining lip and then snap back to be retained under the circumferential retaining lip. A further advantage is that the relatively large diameter of the annular portion and the flexibility of the fins mean that the tamper-evident ring does not significantly obstruct the deformation of the resilient skirt that is needed in order to disengage the closure from the container neck for the first time. Furthermore, the steeply pitched one quarter-turn threads of the assembly according to the present invention ensure that the tamper-evident ring is snapped off the skirt after relatively little angular rotation of the closure cap, thereby helping to ensure efficient separation of the tamper-evident ring if there is any attempt at tampering with the container and closure assembly. Efficient separation of the tamper-evident ring can be further assisted by ratchet projections located below the circumferential retaining lip on the closure neck, wherein the ratchet projections are adapted to cam the flexible fins over the projections when the closure is being screwed onto the container neck, but to block rotation of the flexible fins when the tamper-evident ring is being rotation in an unscrewing direction, i.e. when the closure is being unscrewed from the container neck for the first time.

Specific embodiments of the container and closure assembly according to the present invention will now be described further, by way of example, with reference to the accompanying drawings, in which.

Figure 1:
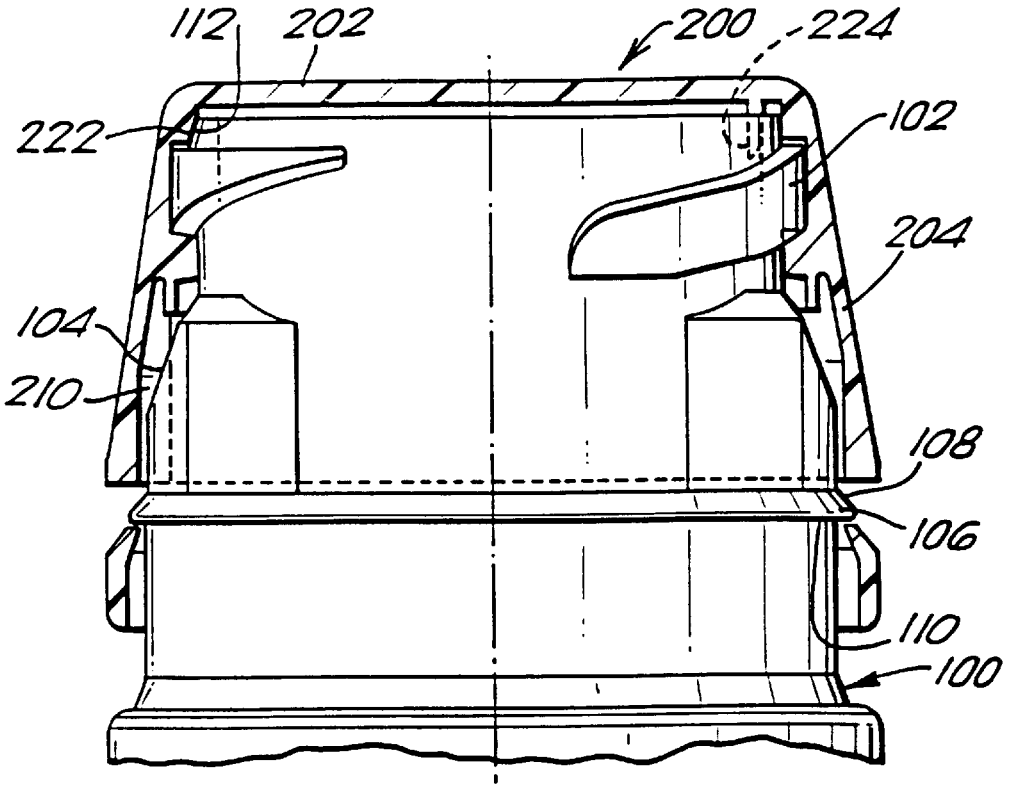
FIG. 1 shows a view of a first embodiment of the container and closure assembly according to the present invention, in which the container neck is shown in elevation and the closure is shown in longitudinal cross-section and two alternative sealing means are shown on opposite sides of the closure.

Referring to FIG. 1, the container and closure assembly according to the present invention comprises a container neck 100 and a closure 200 therefor. The closure 200 is shown in the fully engaged position on the container neck 100. The container neck 100 is provided with two substantially continuous upstanding thread portions 102 for engaging complementary thread portions on the closure 200. The thread portions 102 are pitched at about 11° and each extend about one third of the way around the neck 100 on diametrically opposite sides of the neck, whereby the thread portions 102 are configured and adapted to provide a two-start one quarter-turn closure action. Below the thread portions 102 the container neck 100 is provided with two diametrically opposed first locking elements 104 for engaging complementary locking elements on the skirt of the closure as described further below. Below the locking elements 104 the container neck 100 is provided with a circumferential retaining lip 106 having a sloped upper surface 108 and a flat lower surface 110 for retaining a tamper-evident ring on the container neck 100.

The container neck 100 is also provided with two diametrically opposed anti-rocking bosses 130 adjacent to the locking elements 104. these bosses 130 help to reduce rocking of the closure 200 on the neck 100.

Figure 2:
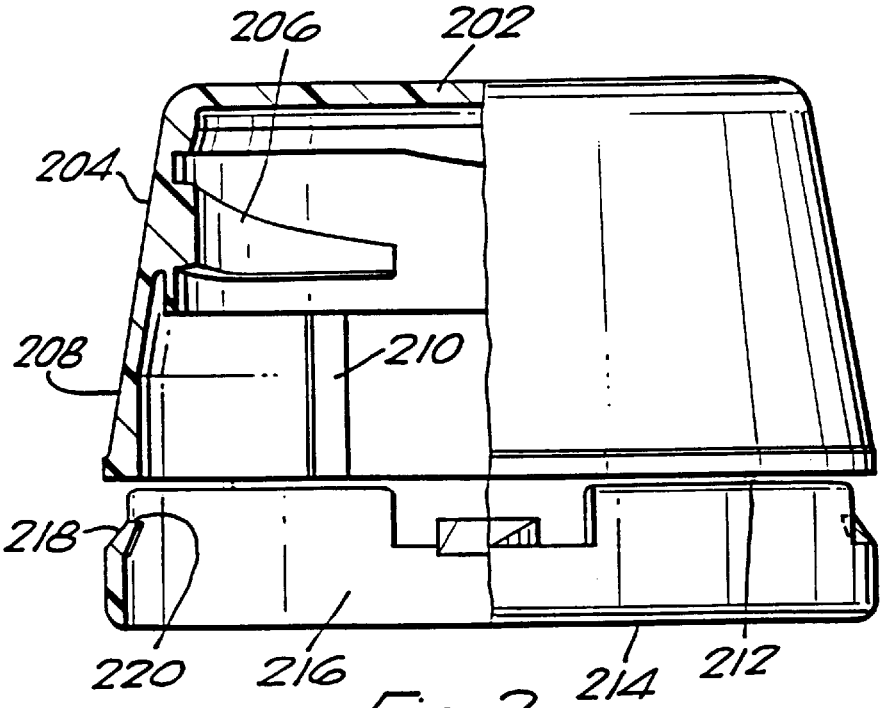
FIG. 2 shows the closure from the assembly of FIG. 1 partly in elevation and partly in longitudinal cross-section.

Referring to FIGS. 1 and 2, the closure 200 comprises a crown portion 202 and a skirt portion 204. An upper part of the skirt portion 204 is provided with two upstanding thread portions 206 that are complementary with the thread portions 102 on the container neck 100, whereby the thread portions 102, 206 together comprise a two-start one quarter-turn closure thread. The upper portion of the closure skirt 204 where the upstanding thread portions 206 are located is relatively thick and non-resilient to minimise deformation and rocking of the upper part of the closure when the closure is fully engaged on the container neck 100. However, a lower portion 208 of the closure is resilient and can be deformed to an oval shape by squeezing opposite sides of the lower skirt 208. Located on an internal surface of the lower skirt 208 there are two diametrically opposite second locking elements 210 for engaging the first locking elements 104 on the container neck when the closure is fully screwed onto the container neck 100.

It will be seen that in this embodiment of the invention there is a single closure skirt 204 having an upper portion bearing the closure thread and a lower, resilient portion 208. However, it will be understood that the present invention encompasses alternative embodiments in which the closure crown has two skirts depending therefrom, namely an inner skirt bearing the closure thread and a concentric, resiliently deformable outer skirt bearing the closure locking elements.

The closure 200 is preferably formed in one piece from thermoplastic material, e.g. by injection moulding. The container neck 100 is likewise preferably formed in one piece from thermoplastic material by injection moulding or blow moulding.

Below the resilient skirt 208 and connected thereto by frangible bridges 212 there is a tamper-evident ring 214. The tamper-evident ring 214 comprises an annular portion 216 having an internal diameter greater than the maximum diameter of the retaining lip 106 on the container neck 100, and a plurality of upwardly and inwardly inclined flexible fins 218 having leading edges 220 for abutting against the lower surface 110 of the retaining lip 106 when the closure 200 is unscrewed from the container neck 100 for the first time.

Returning to the crown portion 202 of the closure 200, two alternative sealing means are shown for providing a seal between the closure 200 and the neck of the container 100. The first alternative sealing means comprises a frustoconical circumferential surface 222 adjacent to the crown portion of the closure 200 for forming an interference seal with a complementary frustoconical circumferential external surface 112 around the lip of the container neck 100. In the second alternative sealing arrangement there is provided a depending circumferential rib 224 extending from the crown portion 202 of the closure and forming a cylindrical plug that fits snugly inside the top of the container neck 100.

Figure 3:
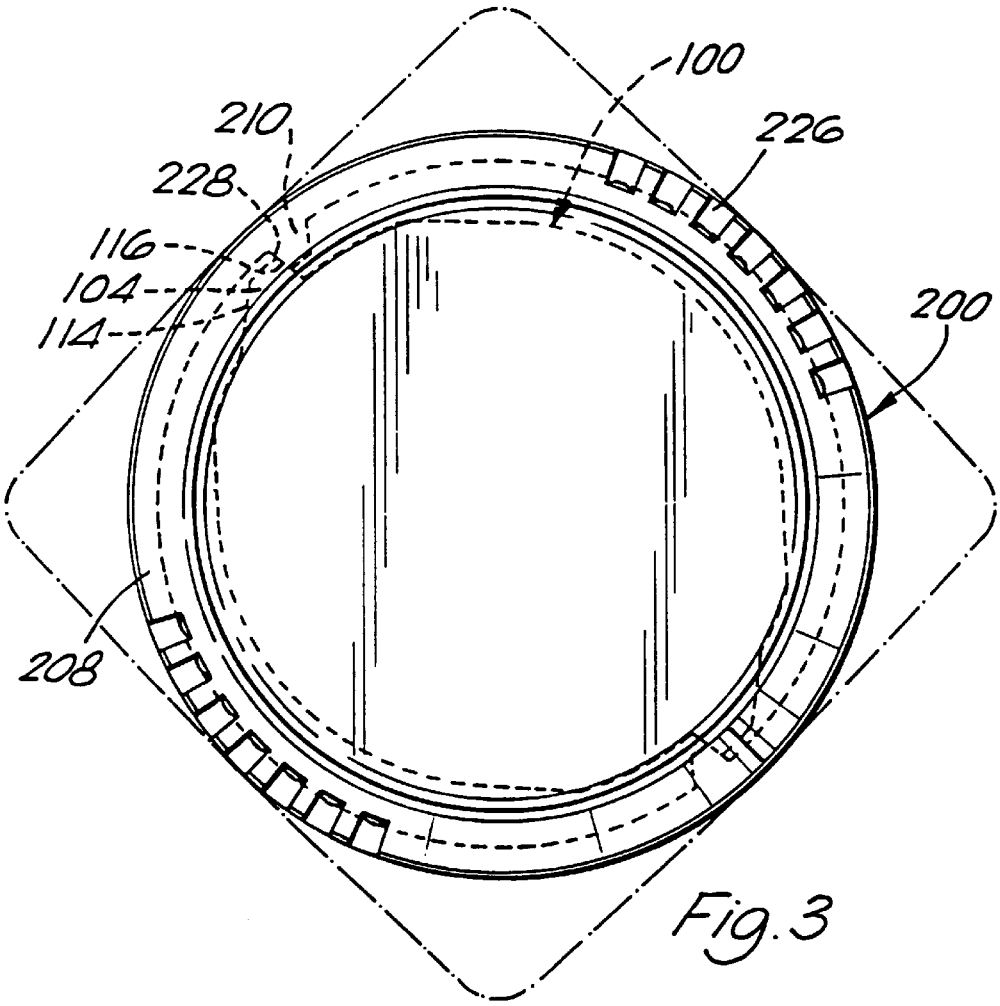
FIG. 3 shows a top plan view of the closure of FIG. 2.

Referring to FIG. 3, the closure 200 is provided with external finger grips 226 in diametrically opposed regions situated radially at 90° from the locking elements 210. The finger grips 226 both assist gripping and also indicate to the user the positions at which radial pressure must be applied to release the locking elements 210, 104 in order to unscrew the closure 200 from the container neck 100.

FIG. 3 also shows in phantom the engagement between the locking elements 104, 210 when the closure 200 is fully engaged on the container neck 100. It can be seen that the locking elements 104, 210 are each substantially trapezoid in transverse cross-section. The first locking element 104 on the container neck 100 is provided with a leading edge ramp 114 inclined at a relatively large angle to the intersecting diameter of the closure 100, and a trailing edge ramp 116 inclined at a relatively small, but still finite, angle to the nearest diameter of the closure. The second locking element 210 on the closure 200 has a trailing edge ramp 228 inclined at an angle complementary to the angle of inclination of ramp 116. It is an important feature of this embodiment that, in the fully engaged position shown in these drawings, the ramps 116 and 228 are abutting and the resilient skirt 208 of the closure 200 is slightly deformed from its equilibrium circular cross-section. The resilient skirt 208 exerts a restoring force directed towards the central axis of the assembly, and the abutment between the ramps 116 and 228 cams this restoring force into a closure torque exerted on the closure 200 when it is this fully engaged and sealing position. The use of such angled ramps on the locking elements to exert a closure torque on the closure when it is at or near its sealing position is described in more detail in GB-A-2267484, incorporated herein by reference.

It will also be readily seen that, when the closure 200 is screwed onto the container neck 100, the second locking element 210 can slide relatively easily up the shallow ramp 114 in order to engage the locking elements 104. However, in order to unscrew the closure 200, it is necessary to deform the resilient skirt 208 by squeezing across the gripping ribs 226 to deform the resilient skirt 208 and thereby push the second locking element 210 radially clear of the first locking element 104. This provides the child-resistant feature of the closure.

Figure 5:
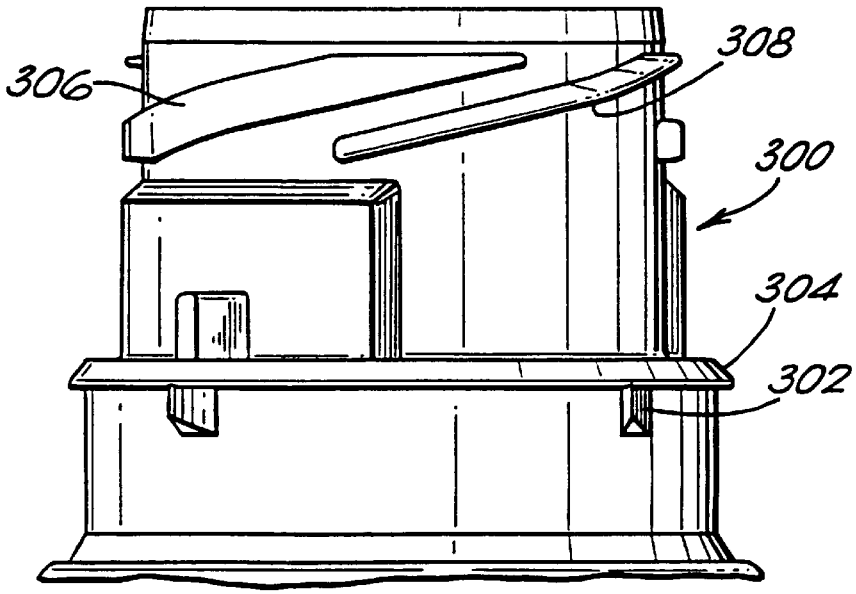
FIG. 5 shows an elevation view of the container neck of an alternative embodiment of the container and closure assembly according to the present invention.
Figure 4:
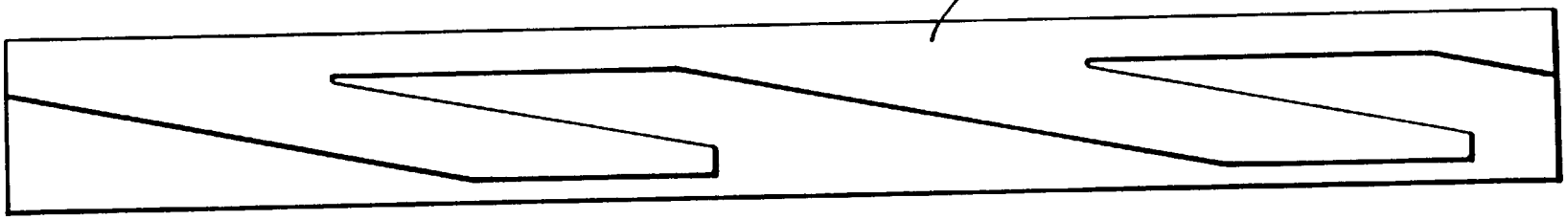
FIG. 4 shows a 360° thread development of the thread on the container neck of the assembly of FIG. 1.
Figure 7:
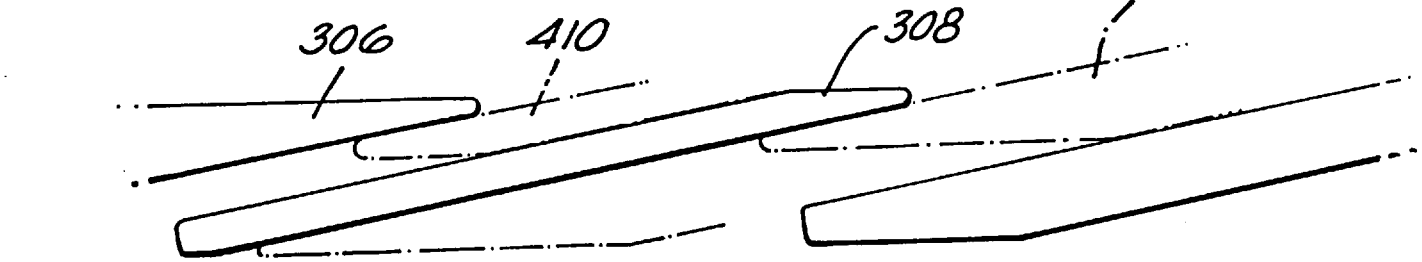
FIG. 7 shows a 360° thread development of the container and closure threads of the alternative embodiment showing the engagement of the closure threads and the container threads.
Figure 6:
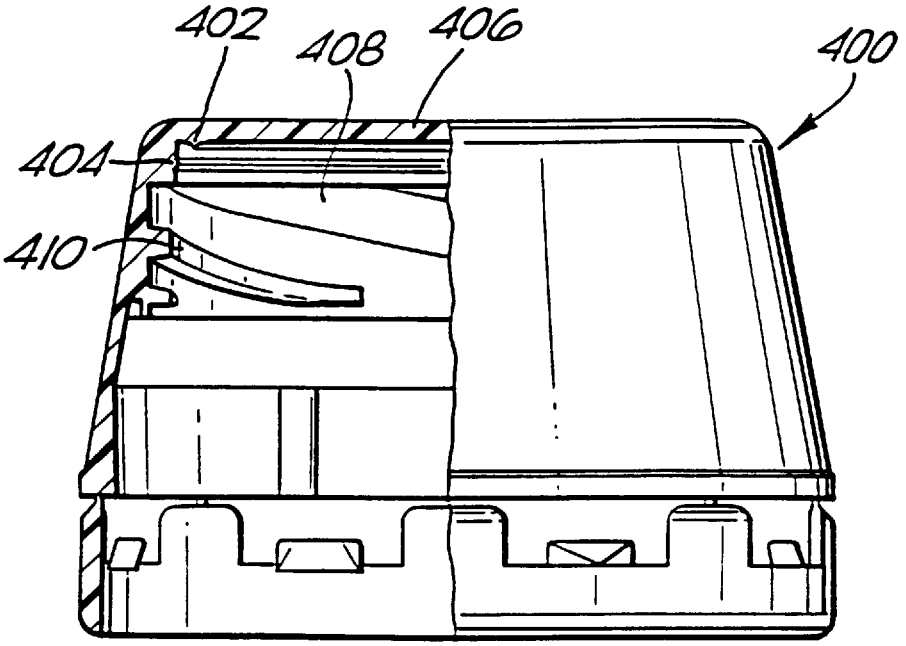
FIG. 6 shows a view of the closure for the container neck of FIG. 5 in the alternative embodiment of the assembly, partly in side elevation and partly in cross-section.

Referring to FIGS. 5 to 7, the alternative embodiment of the container and closure assembly according to the present invention is constructed and arranged substantially similarly to the embodiment hereinbefore described. The following description will only cover those features of the second embodiment that are different from the features already described for the first embodiment.

Referring to FIG. 5, it will be seen that the container neck 300 of the second embodiment is additionally provided with ratchet projections 302 situated below the circumferential retaining lip 304 for retaining the tamper-evident ring on the closure. These ratchet projections 302 allow rotation of the tamper-evident ring in a screwing-down direction, but block rotation of the tamper-evident ring in an unscrewing direction and thereby assist separation of the tamper-evident ring from the closure when the closure is unscrewed from the container neck for the first time.

The main difference of the second embodiment is the construction of the thread. The thread comprises four upstanding thread portions 306, 308 spaced radially around the neck 300. The pitch and length of the thread portions 306, 308 are similar to those for a conventional four-start one quarter-turn thread closure of the kind already known for elderly-friendly closures. However, in order to ensure that the threads can only be engaged at two angular positions consistent with engagement of the first and second locking elements on the container neck and closure, the thread portions 306, 308 are alternately wide and narrow in transverse cross-section. This will be discussed further below in connection with FIG. 7.

Referring to FIG. 6, the closure of the second embodiment 400 differs from the closure 200 by the provision of small, circumferential sealing ribs of triangular cross-section 402, 404 on sealing surfaces adjacent the crown portion 406 of the closure 400. The circumferential sealing ribs 402, 404 help to ensure a leak-tight sealing engagement between the closure and the container neck.

However, once again the main difference between the closure 400 and the previously described closure 200 lies in the shape and configuration of the threads. These comprise four upstanding thread portions 408, 410. The thread portions 408, 410 have length and pitch substantially the same as those of conventional four-start one quarter-turn threads. However, as for the upstanding thread portions 306, 308 of the container neck, and for the same reason, the upstanding thread portions 408, 410 of the closure are alternately wide and thin in transverse cross-section.

Referring now to FIG. 7, it is seen how the threads on the container neck and closure engage when the closure is screwed onto the container neck, it is also apparent from FIG. 10 how thread engagement is only possible from two diametrically opposed predetermined angular positions, whereby it can be ensured that the quarter-turn closure results in engagement of the diametrically opposed locking elements on the container and closure.

The above embodiments have been described by way of example only. Many other embodiments of the present invention as defined in the accompanying claims will be apparent to the skilled reader.

I claim:

1. A child-resistant container and closure assembly comprising:

a container neck comprising a first screw thread comprising first thread portions projecting from the neck and two first locking elements located below said first screw thread on opposite sides of the container neck;

a closure for the container neck comprising a resiliently deformable skirt a second screw thread complementary to the first screw thread and comprising second thread portions projecting inwardly from the skirt, and two second locking elements on opposite sides of the resiliently deformable skirt;

wherein the first and second locking elements mutually engage in ratchet fashion when the closure is screwed onto a fully engaged position on the container neck and subsequently block unscrewing of the closure unless a radial pressure is applied to the skirt at positions spaced from the locking elements to deform the skirt to release the locking elements; and wherein the first and second threads are two-start, substantially continuous steeply pitched threads, wherein the closure can be moved from a substantially fully disengaged position to a substantially fully engaged position on the neck by through a single smooth rotation through about 90° or less and wherein said first thread portions are spaced around said neck sufficiently closely to block non-rotational axial movement of said first thread portions past said second thread portions.

2. A container and closure assembly according to claim 1, wherein the first and second threads each comprise four substantially continuous upstanding thread portions radially spaced around the container neck and the closure, the thread portions having alternately wider and narrower transverse cross-sections, whereby engagement of the first and second threads can only take place at two angular positions of the closure on the container neck.

3. A container and closure assembly according to claim 1, wherein the average pitch of the first and second threads has a value that lies within an angular range of from 5° to 10°.

4. A container and closure assembly according to claim 1, wherein the average pitch of the first and second threads has a value that lies within an angular range of from 8° to 20°.

5. A child-resistant container and closure assembly comprising:

a container neck comprising a first screw thread comprising first thread portions projecting from the neck and two first locking elements located below said first screw thread on opposite sides of the container neck;

a closure for the container neck comprising a resiliently deformable skirt a second screw thread complementary to the first screw thread and comprising second thread portions projecting inwardly from the skirt, and two second locking elements on opposite sides of the resiliently deformable skirt, wherein the first and second threads comprise two substantially continuous thread portions on the container neck and two substantially continuous thread portions on the closure;

wherein the first and second locking elements mutually engage in ratchet fashion when the closure is screwed onto a fully engaged position on the container neck and subsequently block unscrewing of the closure unless a radial pressure is applied to the skirt at positions spaced from the locking elements to deform the skirt to release the locking elements; and wherein the first and second threads are two-start, substantially continuous steeply pitched threads, whereby the closure can be moved from a substantially fully disengaged position to a substantially fully engaged position on the neck by a single smooth rotation through about 180° or less and wherein said first thread portions are spaced around said neck sufficiently closely to block non-rotational axial movement of said first thread portions past said second thread portions.

6. A child-resistant container and closure assembly comprising:

a container neck comprising a first screw thread comprising first thread portions projecting from the neck and two first locking elements located below said first screw thread on opposite sides of the container neck;

a closure for the container neck comprising a resiliently deformable skirt a second screw thread complementary to the first screw thread and comprising second thread portions projecting inwardly from the skirt, and two second locking elements on opposite sides of the resiliently deformable skirt, wherein the first and second threads each comprise four substantially continuous upstanding thread portions radially spaced around the container neck and the closure, the thread portions having alternately wider and narrower transverse cross-sections, whereby engagement of the first and second threads can only take place at two angular positions of the closure on the container neck;

wherein the first and second locking elements mutually engage in ratchet fashion when the closure is screwed onto a fully engaged position on the container neck and subsequently block unscrewing of the closure unless a radial pressure is applied to the skirt at positions spaced from the locking elements to deform the skirt to release the locking elements; and wherein the first and second threads are two-start, substantially continuous steeply pitched threads, whereby the closure can be moved from a substantially fully disengaged position to a substantially fully engaged position on the neck by a single smooth rotation through about 180° or less and wherein said first thread portions are spaced around said neck sufficiently closely to block non-rotational axial movement of said first thread portions past said second thread portions.

7. A container and closure assembly according to claim 6, wherein the average pitch of the first and second threads has a value that lies within an angular range of from 5° to 10°.

8. A container and closure assembly according to claim 6, wherein the average pitch of the first and second threads has a value that lies within an angular range of from 8° to 20°.

9. A container and closure assembly according to claim 6, further comprising a first circumferential sealing surface on the container neck and a second circumferential sealing surface on the closure, wherein the first and second circumferential sealing surfaces abut to form a seal when the closure is fully engaged on the container neck.

10. A container and closure assembly according to claim 6, wherein the first and second locking elements are configured such that abutment between the first and second locking elements are in abutment and the resilient skirt is resiliently deformed at said fully engaged position of the closure on the neck, whereby a restoring force applied by the resilient skirt exerts a positive closure torque to the closure when the closure is in the fully engaged position on the container neck.

11. A container and closure assembly according to claim 6, further comprising:

a circumferential retaining lip on the container neck below the first thread; and a tamper-evident ring depending from the resilient skirt by frangible bridges and provided with an abutment surface that locates under the retaining lip when the closure is fully engaged on the container neck, whereby abutment between the abutment surface and the retaining lip causes the tamper-evident ring to separate from the closure when the closure is disengaged from the container neck for the first time.

12. A child-resistant container and closure assembly comprising:

a container neck comprising a first screw thread comprising first thread portions projecting from the neck and two first locking elements located below said first screw thread on opposite sides of the container neck;

a closure for the container neck comprising a resiliently deformable skirt a second screw thread complementary to the first screw thread and comprising second thread portions projecting inwardly from the skirt, and two second locking elements on opposite sides of the resiliently deformable skirt;

a first circumferential sealing surface on the container neck and a second circumferential sealing surface on the closure, wherein the first and second circumferential sealing surfaces abut to form a seal when the closure is fully engaged on the container neck;

wherein the first and second locking elements mutually engage in ratchet fashion when the closure is screwed onto a fully engaged position on the container neck and subsequently block unscrewing of the closure unless a radial pressure is applied to the skirt at positions spaced from the locking elements to deform the skirt to release the locking elements, wherein the first and second locking elements are configured such that abutment between the first and second locking elements are in abutment and the resilient skirt is resiliently deformed at said fully engaged position of the closure on the neck, whereby a restoring force applied by the resilient skirt exerts a positive closure torque to the closure when the closure is in the fully engaged position on the container neck; and wherein the first and second threads are two-start substantially continuous steeply pitched threads, whereby the closure can be moved from a substantially fully disengaged position to a substantially fully engaged position on the neck by a single smooth rotation through about 180° or less and wherein said first thread portions are spaced around said neck sufficiently closely to block axial movement of said first thread portions past said second thread portions at all angular positions of the closure on said neck.

13. A child-resistant container and closure assembly comprising:

a container neck having a first screw thread and two first locking elements located below said first screw thread on opposite sides of the container neck;

a closure for the container neck having a second screw thread complementary to the first screw thread, a resiliently deformable skirt and two second locking elements on opposite sides of the resiliently deformable skirt wherein the first and second locking elements mutually engage in ratchet fashion when the closure is screwed onto a fully engaged position on the container neck and subsequently block unscrewing of the closure unless a radial pressure is applied to the skirt at positions spaced from the locking elements to deform the skirt to release the locking elements; and wherein the first and second threads are two-start, fast-turn threads, and, wherein the closure can be moved from a substantially fully disengaged position in which the first and second threads are axially spaced apart but rotationally overlapping to said fully engaged position on the neck by rotation through about 90° or less.

14. A child-resistant container and closure assembly comprising:

a container neck having a first screw thread encircling over half the circumference of said container neck and having an upper surface and two first locking elements located below said first screw thread on opposite sides of the container neck;

a closure for the container neck having a second screw thread complementary to the first screw thread for abutment against said upper surface, a resiliently deformable skirt, and two second locking elements on opposite sides of the resiliently deformable skirt;

wherein the first and second locking elements mutually engage in ratchet fashion when the closure is screwed onto a fully engaged position on the container neck and subsequently block unscrewing of the closure unless a radial pressure is applied to the skirt at positions spaced from the locking elements to deform the skirt to release the locking elements; and wherein the first and second threads are two-start, fast-turn threads and said upper surface has a pitch greater than 12° to guide said second screw thread along a steeply pitched substantially helical path, wherein the closure can be moved from a substantially fully disengaged position to a substantially fully engaged position on the neck by rotation through about 90° or less.

15. A child-resistant container and closure assembly comprising:

a container neck having a first screw thread and two first locking elements located below said first screw thread on opposite sides of the container neck;

a closure for the container neck having a second screw thread encircling over half of the circumference of said closure and complementary to the first screw thread, a resiliently deformable skirt, and two second locking elements on opposite sides of the resiliently deformable skirt;

wherein the first and second locking elements mutually engage in ratchet fashion when the closure is screwed onto a fully engaged position on the container neck and subsequently block unscrewing of the closure unless a radial pressure is applied to the skirt at positions spaced from the locking elements to deform the skirt to release the locking elements; and wherein the first and second threads are two-start, fast-turn threads, whereby the closure is guided along a substantially continuous helical path having a pitch greater than 12° from a substantially fully disengaged position to a substantially fully engaged position on the neck by rotation through about 90° or less.

16. A child-resistant container and closure assembly comprising:

a container neck having a first screw thread and two first locking elements located below said first screw thread on opposite sides of the container neck;

a closure for the container neck having a second screw thread complementary to the first screw thread, a resiliently deformable skirt, and two second locking elements on opposite sides of the resiliently deformable skirt;

wherein the first and second locking elements mutually engage in ratchet fashion when the closure is screwed onto a fully engaged position on the container neck and subsequently block unscrewing of the closure unless a radial pressure is applied to the skirt at positions spaced from the locking elements to deform the skirt to release the locking elements; and wherein the first and second threads are two-start, fast-turn threads, and said second thread follows a substantially continuous helical thread path defined by said first thread, wherein the closure can be moved from a substantially fully disengaged position to said fully engaged position on the neck by rotation through about 90° or less.

* * * * *

UNITED STATES PATENT AND TRADEMARK OFFICE

CERTIFICATE OF CORRECTION

PATENT NO. : 5,836,465

DATED : November 17, 1998

INVENTOR(S) : Roger M. King

It is certified that error appears in the above-identified patent and that said Letters Patent is hereby corrected as shown below:

On the Title Page

In column 1, item [30], please change "1996" to --1995--.

In the Claims

In claim 13, line 10, please insert --;-- (semicolon) immediately after "skirt".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*